US008977175B2

(12) United States Patent
Asakawa et al.

(10) Patent No.: US 8,977,175 B2
(45) Date of Patent: Mar. 10, 2015

(54) FIXING APPARATUS HAVING AN OIL ROLLER AND IMAGE FORMING APPARATUS INCLUDING THE SAME

(75) Inventors: Masaya Asakawa, Osaka (JP); Hirokazu Nakamura, Osaka (JP); Takashi Yamanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/002,068

(22) PCT Filed: Feb. 16, 2012

(86) PCT No.: PCT/JP2012/053604

§ 371 (c)(1), (2), (4) Date: Aug. 28, 2013

(87) PCT Pub. No.: WO2012/117859

PCT Pub. Date: Sep. 7, 2012

(65) Prior Publication Data

US 2013/0336688 A1 Dec. 19, 2013

(30) Foreign Application Priority Data

Mar. 3, 2011 (JP) ..... 2011-045804

(51) Int. Cl.
*G03G 15/16* (2006.01)
*G03G 15/20* (2006.01)

(52) U.S. Cl.
CPC ..... *G03G 15/2053* (2013.01); *G03G 15/2025* (2013.01); *G03G 15/206* (2013.01)
USPC ..... 399/325; 399/122

(58) Field of Classification Search
USPC ..... 399/122, 325
See application file for complete search history.

(56) References Cited

U.S. PATENT DOCUMENTS 5,539,509 A * 7/1996 Tomoe et al. ..... 399/159
2003/0215270 A1* 11/2003 Yamada ..... 399/325

FOREIGN PATENT DOCUMENTS

JP 7-261590 A 10/1995
JP 10-319766 A 12/1998
JP 2001-276697 A 10/2001
JP 2002-278346 A 9/2002
JP 2002-287513 A 10/2002
JP 2003-302855 A 10/2003

* cited by examiner

*Primary Examiner* — Billy Lactaoen
(74) *Attorney, Agent, or Firm* — Birch, Stewart, Kolasch & Birch, LLP

(57) ABSTRACT

A fixing apparatus of the invention includes a pressure roller 6 and a fixing roller 7 that make press-contact with each other and an oil roller 8 that makes press-contact with either the pressure roller 6 or the fixing roller 7, and passes a recording sheet through a nip area between the pressure roller 6 and the fixing roller 7 to fix toner on the recording sheet. The fixing apparatus also includes: a pressure roller gear 21 and an oil roller gear 22 that transmit a rotation of a shaft of the pressure roller 6 that makes press-contact with the oil roller 8 to a shaft of the oil roller 8; and a one-way clutch 23 that causes the oil roller 8 to idly rotate in a direction of a driven rotation when the oil roller 8 is driven to rotate by pressing against the pressure roller 6.

11 Claims, 5 Drawing Sheets

FIXING APPARATUS HAVING AN OIL ROLLER AND IMAGE FORMING APPARATUS INCLUDING THE SAME

TECHNICAL FIELD

The present invention relates to a fixing apparatus that includes two rotating members making press-contact with each other and an oil roller making press-contact with either of the rotating members, and that passes a recording sheet through a nip area between the respective rotating members to fix toner on the recording sheet. The present invention also relates to an image forming apparatus that includes the above fixing apparatus.

BACKGROUND ART

Such a fixing apparatus is, for example, applied to an electrophotographic image forming apparatus to fix a toner image transferred on a recording sheet by clamping the recording sheet between respective rotating member (such as a belt, and a roller) and by applying heat and pressure to the recording sheet.

In the above-described fixing apparatus, the oil roller may bring into contact with the rotating member to apply oil on a surface of the rotating member for the purpose of preventing the toner on the recording sheet from transferring and adhering to the surface of the rotating member. Generally, the oil roller is pressed against the rotating member and the rotating member is rotated so that the oil roller is driven to rotate. Thus, oil of the oil roller is uniformly applied on the surface of the rotating member.

However, if paper powder or toner is adhered onto the surface of the rotating member or the surface of the oil roller to cause unevenness of the surface, the oil roller may not be able to move over such an unevenness, and may be slipped and stopped. Also, the oil roller may be variably rotated. As a result, an oil layer formed on the surface of the rotating member may be ununiform.

In view of the foregoing, for example, Patent Literatures 1 and 2 disclose that a dedicated motor for driving the oil roller is provided in order to constantly rotate the oil roller, or to control a rotation speed of the oil roller.

PRIOR ART REFERENCES

Patent Literatures

[Patent Literature 1] JP 2001-276697 A
[Patent Literature 2] JP H10-319766 A

SUMMARY OF THE INVENTION

Problems to be Solved by the Invention

However, as shown in Patent Literatures 1 and 2, in order to provide the dedicated motor for rotating the oil roller, or to control the rotation speed of the oil roller, it is necessary to add the motor and peripheral components for motor control, which increasing costs.

In view of the above circumstances, it is an object of the present invention to provide a fixing apparatus that can prevent the oil roller from being stopped or from being variably rotated, without adding the motor and the peripheral components for the motor control. It is also an object of the present invention to provide an image forming apparatus including the above fixing apparatus.

Means for Solving Problem

To solve the above problem, a fixing apparatus of the present invention includes two rotating members making press-contact with each other and an oil roller making press-contact with either of the rotating members, and fixes toner on a recording sheet by passing the recording sheet through a nip area between the rotating members. The fixing apparatus also includes a gear power transmission portion that transmits a rotation of a shaft of the rotating member that makes press-contact with the oil roller to a shaft of the oil roller, and a one-way clutch that causes the oil roller to idly rotate in a direction of a driven rotation when the oil roller is driven to rotate by making press-contact with the rotating member.

With the configuration of the present invention, the gear power transmission portion transmits a rotation of the shaft of the rotating member that makes press-contact with the oil roller to the shaft of the oil roller. Therefore, when the rotating member is rotated, even if the oil roller is slipped relative to the rotating member, the oil roller is rotated without default. Thus, it is possible to reduce ununiformity of oil on the surface of the rotating member.

The oil roller is driven to rotate accompanying the rotation of the rotating member because the oil member makes press-contact with the rotating member. The oil roller is provided with the one-way clutch that makes the oil roller idly rotate in the direction of the driven rotation. Thus, to the extent that a driven rotation speed of the oil roller is higher than a rotation speed transmitted by the gear power transmission portion, the one-way clutch is idly rotated to maintain the driven rotation of the oil roller, thereby it is possible to apply oil uniformly on the surface of the rotating member.

Furthermore, in the fixing apparatus of the present invention, preferably the one-way clutch is idly rotated when the driven rotation speed of the oil roller is higher than the rotation speed transmitted to the oil roller via the gear power transmission portion, and the one-way clutch is locked up when the driven rotation speed is lower than the transmitted rotation speed.

In this case, since the one-way clutch is idly rotated when the driven rotation speed of the oil roller is higher than the rotation speed transmitted via the gear power transmission portion, the driven rotation of the oil roller is maintained. Also, since the one-way clutch is locked up when the driven rotation speed of the oil roller is lower than the rotation speed transmitted via the gear power transmission portion, the oil roller is rotated by the gear power transmission portion.

Also, in the fixing apparatus of the present invention, preferably, a ratio of the peripheral length of the oil roller relative to the peripheral length of the rotating member is smaller than a reduction gear ratio of the gear power transmission portion.

In this case, when the oil roller is not slipped relative to the rotating member, the driven rotation speed of the oil roller accompanying the rotation of the rotating member is higher than the rotation speed transmitted by the gear power transmission portion. Then, the one-way clutch is idly rotated to maintain the driven rotation of the oil roller. When the oil roller is slipped relative to the rotating member and the driven rotation speed of the oil roller becomes low, the driven rotation speed of the oil roller is lower than the gear rotation speed transmitted by the gear power transmission portion. Then, the one-way clutch is locked up and the oil roller is rotated by the gear power transmission portion.

Furthermore, in the fixing apparatus of the present invention, it is preferable that: the gear power transmission portion has an oil roller gear provided on the shaft of the oil roller and a front stage gear that is located upstream of the oil roller gear and that meshes with the oil roller gear; the oil roller and the oil roller gear are individually supported so as to be contacted with and separated from the rotating member and the front stage gear; a first spring and a second spring are provided, the first spring biasing the oil roller in a direction close to the rotating member, and the second spring biasing the oil roller gear in a direction close to the front stage gear; and the biasing force by the first spring is less than the biasing force by the second spring.

In this case, the oil roller makes press-contact with the rotating member by being biased by the first spring. The oil roller gear meshes with the front stage gear by being biased by the second spring. The biasing force by the first spring is less than the biasing force by the second spring. When the diameter of the oil roller and the diameter of the rotating member increase by thermal expansion, the oil roller is moved in the direction away from the rotating member against the small biasing force of the first spring while engagement of the oil roller gear with the front stage gear is maintained by the large biasing force of the second spring, thus a suitable press-contact pressure can be maintained between the oil roller and the rotating member.

In the fixing apparatus of the present invention, preferably, a joint portion is provided between the oil roller and a shaft end portion of the oil roller, so that the oil roller can be moved in a direction close to and away from the rotating member.

Here, in order to transmit the rotation of the shaft of the rotating member to the shaft of the oil roller by the gear power transmission portion, it is necessary to position the shaft of the rotating member, the shaft of the oil roller, the shaft of the gear and the like so that engagement of the gears is maintained. However, in the fixing apparatus, the rotating member and the oil roller are heated and the outer diameter of the rotating member and the outer diameter of the oil roller are changed. Therefore, fixing of the positions of the shaft of the rotating member and the shaft of the oil roller results in overload to the rotating member, the oil roller, their shafts and the like. In view of the foregoing, a joint portion is provided between the oil roller and the shaft end portion of the oil roller, so that the oil roller can be moved in the direction close to and away from the rotating member. Thus, the oil roller can be moved in the direction close to and away from the rotating member while the shaft end portion of the oil roller is fixed and positioned.

Also, an image forming apparatus of the present invention includes the above-described fixing apparatus of the present invention.

In the image forming apparatus of the present invention, it is possible to provide the same operations and effects as the above-described fixing apparatus of the present invention.

Effects of the Invention

With the configuration of the present invention, the gear power transmission portion transmits the rotation of the shaft of the rotating member that makes press-contact with the oil roller to the shaft of the oil roller. Therefore, when the rotating member is rotated, even if the oil roller is slipped relative to the rotating member, the oil roller is rotated without default. Thus, it is possible to reduce ununiformity of oil on the surface of the rotating member.

Furthermore, the oil roller is driven to rotate accompanying the rotation of the rotating member because the oil member makes press-contact with the rotating member. The oil roller is provided with the one-way clutch that makes the oil roller idly rotate in the direction of the driven rotation. Thus, to the extent that the driven rotation speed of the oil roller is higher than the rotation speed transmitted by the gear power transmission portion, the one-way clutch is idly rotated to maintain the driven rotation of the oil roller, thereby it is possible to apply oil uniformly on the surface of the rotating member.

MODES FOR CARRYING OUT THE INVENTION

Hereinafter, an embodiment of the present invention will be described in detail with reference to the drawings.

Figure 1:
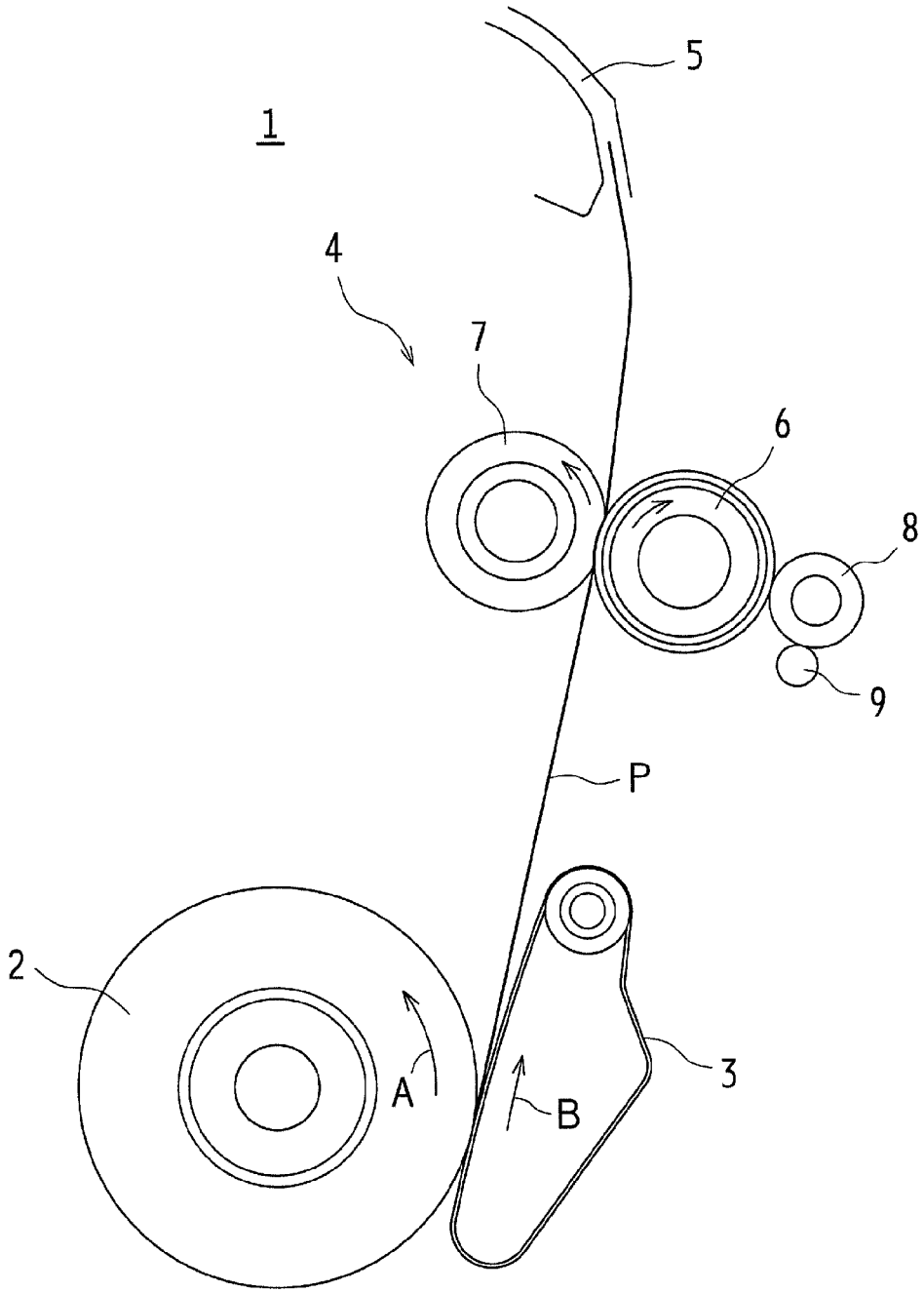
FIG. 1 is a enlarged cross-sectional view showing a main part of an image forming apparatus to which is applied a fixing apparatus according to an embodiment of the present invention.

FIG. 1 is a enlarged cross-sectional view showing a main part of an image forming apparatus to which is applied a fixing apparatus according to an embodiment of the present invention. This electrophotographic image forming apparatus 1 includes a photosensitive drum 2, a transfer belt 3, a fixing apparatus 4 and the like. The photosensitive drum 2, which has a photosensitive layer on a surface thereof, is rotated in a direction indicated by an arrow A at a constant rotation speed. According to the rotation of the photosensitive drum 2, the surface of the photosensitive drum 2 is uniformly electrified to a prescribed potential by an electrifying device (not shown). An exposure device (not shown) exposes the surface of the photosensitive drum 2 to form an electrostatic latent image thereon. The electrostatic latent image on the surface of the photosensitive drum 2 is developed as a toner image by a development device (not shown).

The transfer belt 3 is driven to circulate in a direction indicated by an arrow B at the same speed as a surface speed of the photosensitive drum 2. The photosensitive drum 2 makes press-contact with the transfer belt 3 so as to form a nip area therebetween. A recording sheet P is transported from the downward and guided to the nip area. While the recording sheet P is transported through the nip area, the toner image on the surface of the photosensitive drum 2 is transferred onto the recording sheet P. In order to transfer the toner image, a high-voltage transfer bias (high voltage having a polarity (+) reverse to a charged polarity (−) of the toner) is applied to the transfer belt 3.

The recording sheet P is transported upward to be guided to the fixing apparatus 4. The fixing apparatus 4 rotataboly supports a pressure roller 6 and a fixing roller 7 that make press-contact with each other to form a nip area therebetween. The recording sheet P is clamped by the nip area so that heat and pressure are applied to the recording sheet P to fix the toner image on the recording sheet P. Also, with the pressure roller 6, an oil roller 8 makes press-contact to apply oil on the surface of the pressure roller 6. By such applying, the toner on the recording sheet P is prevented from transferring and adhering onto the surface of the pressure roller 6.

The pressure roller 6 is a roller having a three-layer structure that consists of a hollow shaft, an elastic layer provided on an outer surface of the hollow shaft, and a release layer provided on an outer surface of the elastic layer. The fixing roller 7 is also a roller having a three-layer structure that consists of a hollow shaft, an elastic layer provided on an outer surface of the hollow shaft, and a release layer provided on an outer surface of the elastic layer. The pressure roller 6 and the fixing roller 7 include, inside their hollow shafts, respective heater lamps (halogen lamps) for heating the respective rollers 6 and 7.

Here, the pressure roller 6 is rotated, and the fixing roller 7 is driven to rotate by the pressure roller 6. The recording sheet P is transported through the nip area between the rollers 6 and 7 and is heated and pressed at the nip area so that the toner image on the recording sheet P is fixed.

Thus, after the toner image on the recording sheet P is fixed, the recording sheet P is further transported upward through a transport path 5, and is discharged to a discharge tray (not shown).

Figure 2:
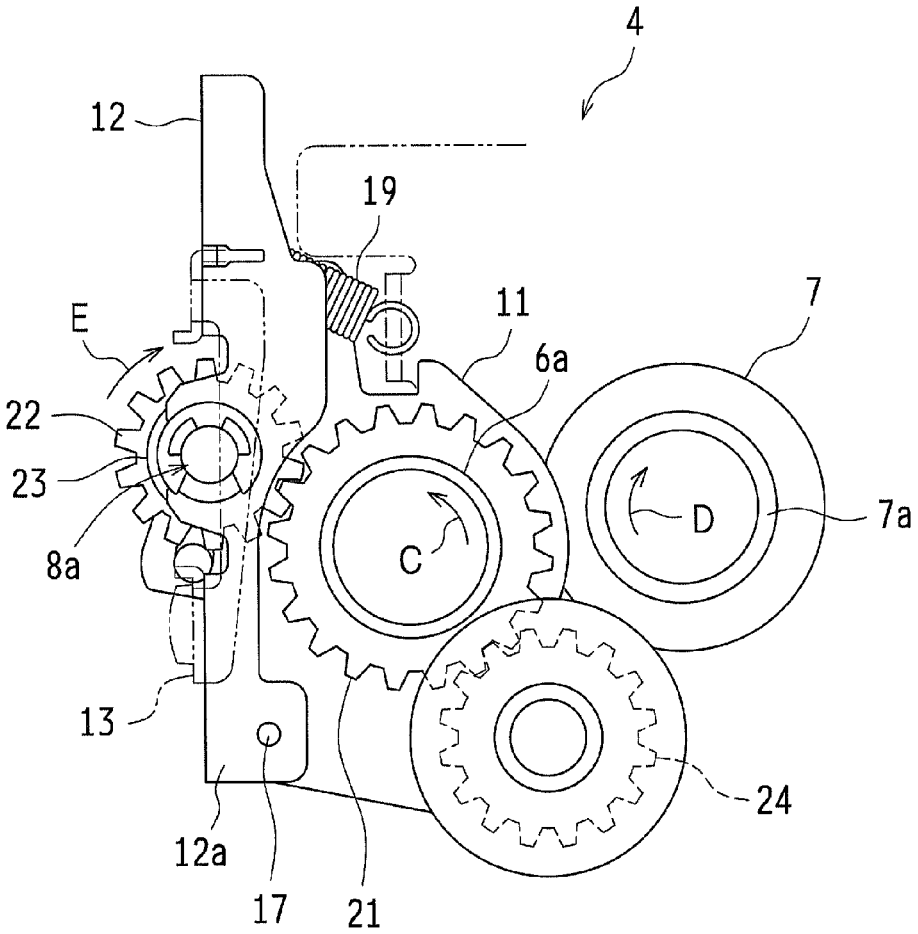
FIG. 2 is a side view showing the fixing apparatus of FIG. 1.
Figure 3:
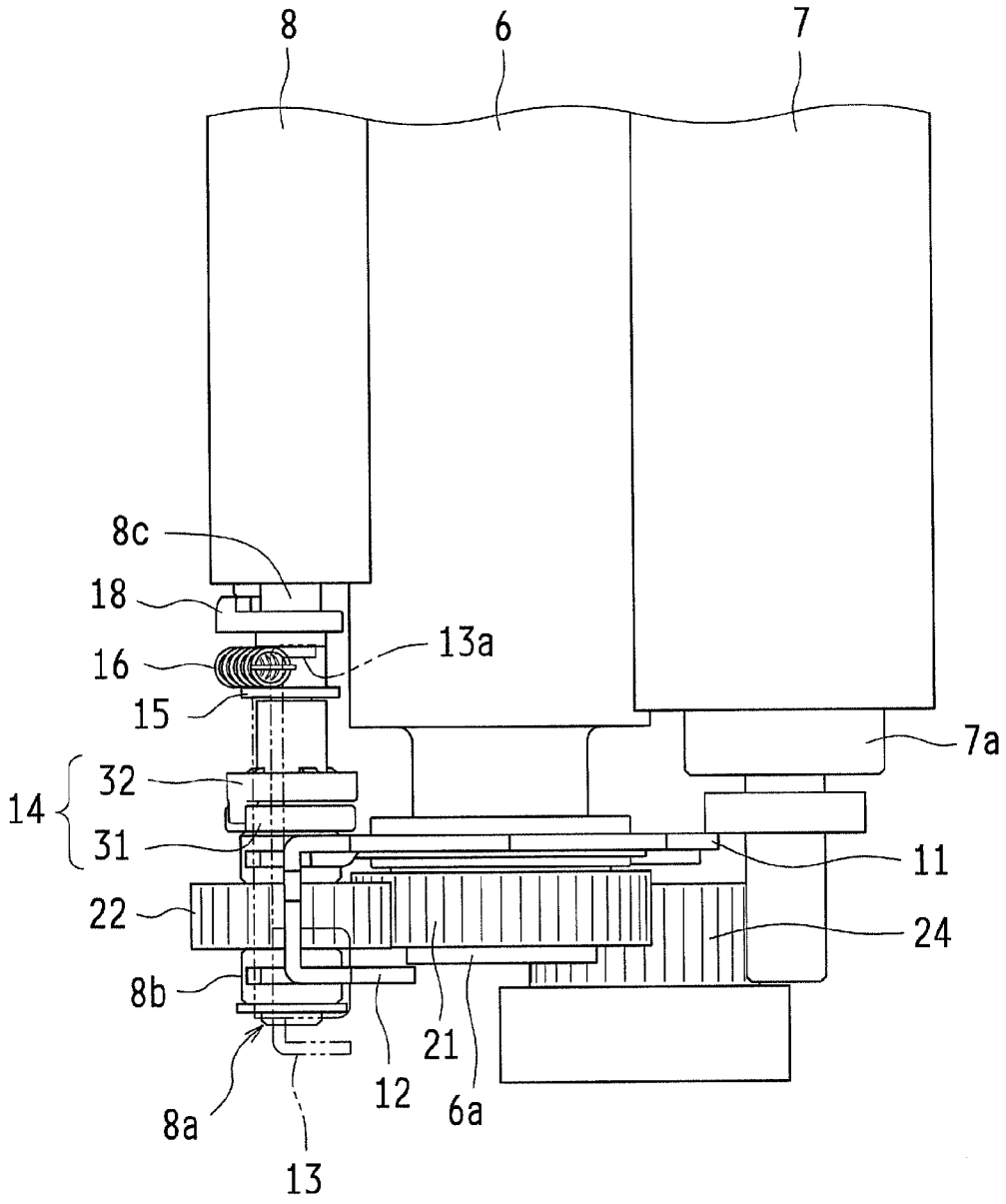
FIG. 3 is a plain view showing a vicinity of one end of a pressure roller and a fixing roller of the fixing apparatus of FIG. 1.
Figure 4:
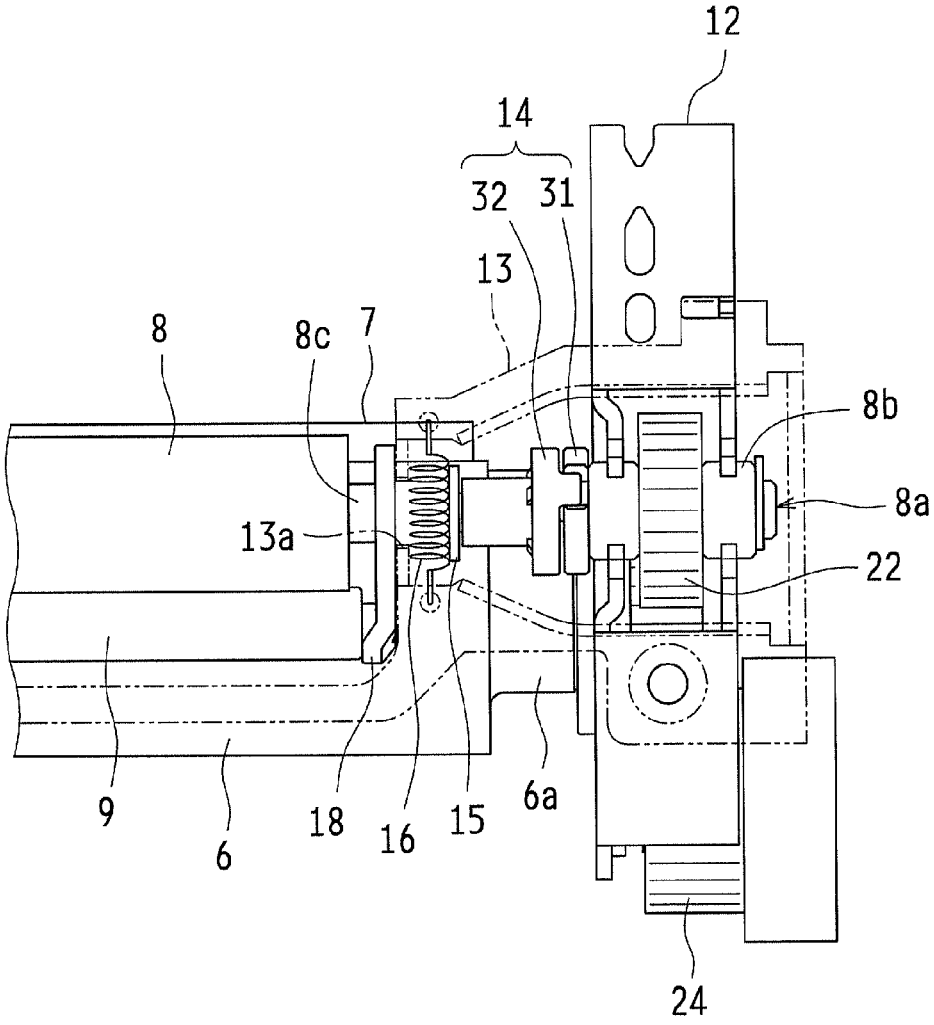
FIG. 4 is a front view showing a vicinity of one end of the pressure roller and the fixing roller of the fixing apparatus of FIG. 1.

Next, a description will be given, further in detail, of the configuration of the fixing apparatus 4 according to the present embodiment. FIG. 2 is a side view showing the fixing apparatus 4. FIGS. 3 and 4 are respectively a plain view and a front view showing a vicinity of one end of the pressure roller 6 and the fixing roller 7 of the fixing apparatus 4.

In the fixing apparatus 4, respective supporting frames 11 are provided on both end sides of the pressure roller 6. Both ends of a shaft 6*a* of the pressure roller 6 are rotatably supported and positioned by the respective supporting frames 11.

Also, respective movable frames (not shown), which are movably supported relative to the supporting frames 11, are provided on both end sides of the fixing roller 7. Both ends of a shaft 7*a* of the fixing roller 7 are rotatably supported by the respective movable frames. The movable frames are biased by respective springs (not shown) so that the fixing roller 7 makes press-contact with the pressure roller 6.

Furthermore, respective rocking frames 12 are provided on both end sides of the oil roller 8. The respective rocking frames 12 are coupled with each other via a sub frame 13. A shaft 8*a* of the oil roller 8 is rotatably supported by the sub frame 13. Each lower end 12*a* of the corresponding rocking frame 12 is rotatably supported by each shaft 17 located in a vicinity of a lower end of the corresponding supporting frame 11. Each rocking frame 12 is biased by a corresponding spring 19 in a clockwise direction around the corresponding shaft 17. In this way, the respective rocking frames 12 are biased in the clockwise direction, which makes the sub frame 13 and the shaft 8*a* of the oil roller 8 be biased in a direction close to the pressure roller 6, and thus, the oil roller 8 makes press-contact with the pressure roller 6.

The shaft 8*a* of the oil roller 8 is made by connecting a movable shaft portion 8*c* that passes through a center of the oil roller 8 with a shaft end portion 8*b* that is rotatably supported by one rocking frame 12 via a joint portion 14. The joint portion 14 includes a first rotation portion 31 that is connected to the shaft end portion 8*b* and a second rotation portion 32 that is connected to the movable shaft portion 8*c*. The first rotation portion 31 and the second rotation portion 32 are engaged with each other, thus the shaft end portion 8*b* is connected to the movable shaft portion 8*c* so that the rotation of the shaft end portion 8*b* is transmitted to the movable shaft portion 8*c* and that the movable shaft portion 8*c* can be moved in a direction close to/away from the pressure roller 6.

Figure 5:
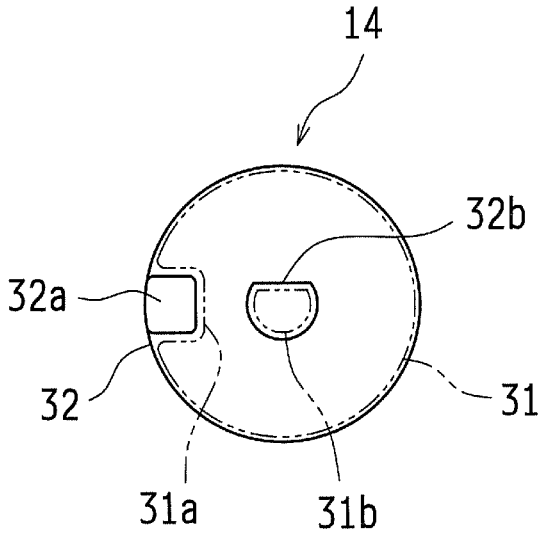
FIG. 5 is a cross-sectional view showing a joint portion provided on an oil roller of the fixing apparatus of FIG. 1.

As shown in the cross-sectional view of FIG. 5, the first rotation portion 31, which has a disk shape, includes a recess portion 31*a* formed in a vicinity of a periphery of the disk and a D-shaped shaft 31*b* formed in a center of the disk. The second rotation portion 32, which has a disk shape, includes a protrusion portion 32*a* formed in a vicinity of a periphery of the disk and a D-shaped hole 32*b* formed in a center of the disk.

The first rotation portion 31 and the second rotation portion 32 are disposed opposite to each other to approach one to another so that the protrusion portion 32*a* of the second rotation portion 32 is fit into the recess portion 31*a* of the first rotation portion 31, and that the D-shaped shaft 31*b* of the first rotation portion 31 is inserted into the D-shaped hole 32*b* of the second rotation portion 32, thus the first rotation portion 31 and the second rotation portion 32 are connected to each other.

When the first rotation portion 31 is rotated in a state in which the first rotation portion 31 is connected to the second rotation portion 32, the protrusion portion 32*a* of the second rotation portion 32 is driven to rotate by the rotation of the recess portion 31*a* of the first rotation portion 31, and the D-shaped hole 32*b* of the second rotation portion 32 is driven to rotate by the rotation of the D-shaped shaft 31*b* of the first rotation portion 31.

Since the protrusion portion 32*a* of the second rotation portion 32 is sufficiently smaller than the recess portion 31*a* of the first rotation portion 31, the protrusion portion 32*a* can be moved within a scope in which it makes contact with the inner periphery of the recess portion 31*a* of the first rotation portion 31. Also, since the D-shaped shaft 31*b* of the first rotation portion 31 is sufficiently smaller than the D-shaped hole 32*b* of the second rotation portion 32, the D-shaped shaft 31*b* can be moved within a scope in which it makes contact with the inner periphery of the D-shaped hole 32*b* of the second rotation portion 32. Therefore, the second rotation portion 32 can be moved within a fixed scope relative to the first rotation portion 31. Thus, the movable shaft portion 8*c* that is connected to the second rotation portion 32 can be moved within a fixed scope in any directions perpendicular to the shaft 8*a* relative to the shaft end portion 8*b* that is connected to the first rotation portion 31.

Thus, the joint portion 14 connects the shaft end portion 8*b* to the movable shaft portion 8*c* so that the rotation of the shaft end portion 8*b* is transmitted to the movable shaft portion 8*c*, and allows the movable shaft portion 8*c* to move in the direction close to/away from the pressure roller 6.

As shown in FIGS. 3 and 4, respective bearings 15 of the both ends of the movable shaft portion 8*c* are each inserted into a corresponding guide groove 13*a* of the sub frame 13 so that the respective bearings 15 are movably supported in the direction close to/away from the pressure roller 6. Each bearing 15 is biased in the direction close to the pressure roller 6 by a corresponding spring 16. In this way, the oil roller 8 is rotatably supported. Also, the oil roller 8 is movably supported in the direction close to/away from, and biased in the direction close to, the pressure roller 6.

Furthermore, a backup roller 9 is rotatably supported by a pair of brackets 18 that is inserted respectively into vicinities of the both ends of the movable shaft portion 8*c* of the oil roller 8 so that the backup roller 9 makes press-contact with the oil roller 8.

As described above, in the fixing apparatus 4, the pressure roller 6 is positioned, and the fixing roller 7 and the oil roller 8 are movably supported by and pressed against the pressure roller 6.

As shown in FIGS. 2-4, a pressure roller gear 21 is fixed concentrically to the pressure roller 6 on one end of the shaft 6*a* of the pressure roller 6 that is rotatably supported by one supporting frame 11. Also, an oil roller gear 22 is fixed on the shaft end portion 8*b* of the oil roller 8 that is rotatably supported by one rocking frame 12. As described above, since each rocking frame 12 is biased in the clockwise direction around the corresponding shaft 17, the oil roller gear 22 becomes meshed with the pressure roller gear 21 at the time of pressing the oil roller 8 against the pressure roller 6.

In the oil roller gear 22, a one-way clutch 23 is embedded. The one-way clutch 23 interposes between the oil roller gear 22 and the shaft end portion 8*b* of the oil roller 8. The one-way clutch 23 is idly rotated when the shaft 8*a* (the shaft end portion 8*b* and the movable shaft portion 8*c*) of the oil roller 8 is rotated in a direction indicated by an arrow E at a rotation speed higher than that of the oil roller gear 22, so that the rotation of the oil roller gear 22 is not transmitted to the shaft 8*a* of the oil roller 8. The one-way clutch 23 is locked up when the shaft 8*a* of the oil roller 8 (the shaft end portion 8*b* and the movable shaft portion 8*c*) is rotated in the direction indicated by the arrow E at a rotation speed lower than that of the oil roller gear 22, so that the rotation of the oil roller gear 22 is transmitted to the shaft 8*a* of the oil roller 8.

In the fixing apparatus 4 having the above-described configuration, a drive gear 24 of the image forming apparatus 1 meshes with the pressure roller gear 21. When the drive gear 24 is rotated, the pressure roller gear 21 is rotated in a direction indicated by an arrow C, and the pressure roller 6 is rotated. The fixing roller 7, which makes press-contact with the pressure roller 6, is driven to rotate in a direction indicated by an arrow D. Also, the oil roller 8, which makes press-contact with the pressure roller 6, is driven to rotate in the direction indicated by the arrow E.

Also, when the pressure roller gear 21 is rotated in the direction indicated by the arrow C, the oil roller gear 22 is rotated in the direction indicated by the arrow E.

As described above, the one-way clutch 23 is idly rotated when the shaft 8*a* of the oil roller 8 is rotated in the direction indicated by the arrow E at the rotation speed higher than that of the oil roller gear 22. The one-way clutch 23 is locked up when the shaft 8*a* of the oil roller 8 is rotated in the direction indicated by the arrow E at the rotation speed lower than that of the oil roller gear 22, so that the rotation of the oil roller gear 22 is transmitted to the shaft 8*a* of the oil roller 8. For this reason, when the driven rotation speed of the oil roller 8 by being pressed against the pressure roller 6 is higher than the rotation speed of the oil roller gear 22, the one-way clutch 23 is idly rotated so as to maintain the driven rotation of the oil roller 8. Also, when the driven rotation speed of the oil roller 8 is lower than the rotation speed of the oil roller gear 22, the one-way clutch 23 is locked up so that the oil roller 8 is rotated together with the oil roller gear 22.

Here, a ratio of the peripheral length of the oil roller 8 relative to the peripheral length of the pressure roller 6 (ratio of the outer diameter of the oil roller 8 relative to the outer diameter of the pressure roller 6 (outer diameter ratio)) is set to be smaller than a reduction gear ratio of the oil roller gear 22 relative to the pressure roller gear 21. For example, the outer diameter of the pressure roller 6 is ϕ30 (mm), the outer diameter of the oil roller 8 is ϕ16 (mm), and thus the outer diameter ratio is set to 0.53. The number of teeth of the pressure roller gear 21 is 28T, the number of teeth of the oil roller gear 22 is 18T, and thus the reduction gear ratio is set to 0.64 (>0.53).

In this case, unless the oil roller 8 is slipped relative to the pressure roller 6 and the driven rotation speed of the oil roller 8 decreases, the driven rotation speed of the oil roller 8 is higher than the rotation speed of the oil roller gear 22, thus the one-way clutch 23 is idly rotated to maintain the driven rotation of the oil roller 8. Also, when the oil roller 8 is slipped relative to the pressure roller 6 and the driven rotation speed of the oil roller 8 decreases, the driven rotation speed of the oil roller 8 becomes lower than the rotation speed of the oil roller gear 22, thus the one-way clutch 23 is locked up so that the oil roller 8 is rotated together with the oil roller gear 22.

Therefore, if the surface of the pressure roller 6 or the surface of the oil roller 8 is clean and the oil roller 8 is not slipped relative to the pressure roller 6, the driven rotation speed of the oil roller 8 does not decrease. Thus, the one-way clutch 23 is idly rotated and the oil roller 8 is driven to rotate by the pressure roller 6, so that oil is uniformly applied on the surface of the pressure roller 6 by the oil roller 8.

If paper powder or toner is adhered onto the surface of the pressure roller 6 or the surface of the oil roller 8 to cause unevenness of the surface, and if the oil roller 8 cannot move over such an unevenness and is slipped, the driven rotation speed of the oil roller 8 decreases, thus the one-way clutch 23 is locked up so that the oil roller 8 is rotated together with the oil roller gear 22. Therefore, the oil roller 8 continues to rotate relative to the pressure roller 6 regardless of its delay of rotation, so that oil ununiformity of the surface of the pressure roller 6 is reduced.

In the fixing apparatus 4 as described above, in order to transmit the rotation of the pressure roller gear 21 to the oil roller gear 22, the shaft of the pressure roller gear 21 and the shaft of the oil roller gear 22 are required to be positioned always and suitably spaced apart from each other so as to maintain engagement between the gears 21 and 22.

However, the pressure roller 6 and the fixing roller 7 are heated by the respective heater lamps to maintain the fixing temperature of the nip area (for example, 165° C.). Also, since the oil roller 8 is heated by thermal conduction from the pressure roller 6, the outer diameter of the pressure roller 6 and the outer diameter of the oil roller 8 are changed due to their thermal expansion. Or, if the fixing apparatus 4 is operated during a long time period, oil is dropped out from the oil roller 8 to change the outer diameter of the oil roller 8. In the event that the shaft 6*a* of the pressure roller 6 and the shaft 8*a* of the oil roller 8 are fixed and positioned, press-contact pressure between the pressure roller 6 and the oil roller 8 is remarkably changed due to change of their outer diameters, and overload is applied to their shafts.

Furthermore, the outer diameter of the pressure roller gear 21 and the outer diameter of the oil roller gear 22 are changed by thermal expansion, which affects the engagement between the respective gears 21 and 22.

In view of the foregoing, in the fixing apparatus 4, the shaft end portion 8*b* of the oil roller 8 and the movable shaft portion 8*c* are connected via the joint portion 14 by which the movable shaft portion 8*c* is movable in the direction close to/away from the pressure roller 6. Also, each bearing 15 on the both ends of the movable shaft portion 8*c* is movably supported in the direction close to/away from the pressure roller 6 by the sub frame 13. Each bearing 15 is biased in the direction close to the pressure roller 6 by the corresponding spring 16, thereby, the oil roller 8 is movably supported in the direction close to/away from the pressure roller 6 and biased in the direction close to the pressure roller 6. From this reason, when the outer diameter of the pressure roller 6 and the outer diameter of the oil roller 8 increase, the oil roller 8 is moved in the direction away from the pressure roller 6 against biasing force of the respective springs 16. Thus, suitable press-contact pressure is maintained between the oil roller 8 and the pressure roller 6, and no overload is applied to the shaft 6*a* and the shaft 8*a*.

Also, each rocking frame 12 is biased in the clockwise direction around the corresponding shaft 17 by the corresponding spring 19, thereby the oil roller 8 makes press-contact with the pressure roller 6 and the oil roller gear 22 meshes with the pressure roller gear 21. Thus, when the outer diameter of the pressure roller gear 21 and the outer diameter of the oil roller gear 22 increase by thermal expansion, the gears 21 and 22 press against each other to be slightly pushed back. Then, each rocking frame 12 is rotated in the counter-clockwise direction around the corresponding shaft 17 so as to maintain the suitable engagement between the gears 21 and 22.

Biasing force of the oil roller 8 by respective springs 16 is set to be sufficiently smaller than that of the oil roller 8 and the oil roller gear 22 by the respective springs 19. Thus, the oil roller 8 can be moved in the direction away from the pressure roller 6 against the biasing force of the respective springs 16 while the engagement between the oil roller gear 22 and the pressure roller gear 21 is maintained by the corresponding spring 19.

As described above, the fixing apparatus 4 according to the present embodiment, the one-way clutch 23 interposes between the oil roller gear 22 and the shaft 8*a* of the oil roller 8, and the ratio of the outer diameter of the oil roller 8 relative to the outer diameter of the pressure roller 6 is set to be smaller than the reduction gear ratio of the oil roller gear 22 relative to the pressure roller gear 21. Thus, generally the one-way clutch 23 is idly rotated to maintain the driven rotation of the oil roller 8. Also, when the oil roller 8 is slipped, the one-way clutch 23 is locked up so that the oil roller 8 is rotated together with the oil roller gear 22. Therefore, in an oil layer formed on the surface of the pressure roller 6, oil ununiformity is not generated.

The shaft end portion 8*b* of the oil roller 8 and the movable shaft portion 8*c* are connected via the joint portion 14 by which the movable shaft portion 8*c* (oil roller 8) can be moved in the direction close to/away from the pressure roller 6. In this way, when the outer diameter of the pressure roller 6 and the outer diameter of the oil roller 8 increase, the oil roller 8 is moved in the direction away from the pressure roller 6 against the biasing force of the respective springs 16. Thus, suitable press-contact pressure is maintained between the oil roller 8 and the pressure roller 6, and no overload is applied to the shaft 6*a* and the shaft 8*a*.

While the preferred embodiment of the present invention has been described with reference to the drawings, the present invention should not be limited thereto. It is to be understood that various modifications and corrections will be apparent to those skilled in the art without departing from the scope of the appended claims of the present invention. It is to be construed that the above modifications and corrections are also within the technical scope of the present invention. For example, in the above-described embodiment, the nip area is formed between the pressure roller and the fixing roller. However, the nip area may be formed between a rotating belt and a roller to fix toner of a recording sheet. Also, in place of the joint portion 14, another system may be used. For example, an Oldham's coupling may be used.

DESCRIPTION OF REFERENCE NUMERALS

1 image forming apparatus
2 photosensitive drum
3 transfer belt
4 fixing apparatus
5 transport path
6 pressure roller (rotating member)
7 fixing roller (rotating member)
8 oil roller
9 backup roller
11 supporting frame
12 rocking frame
13 sub frame
14 joint portion
15 bearing
16 spring (first spring)
17 shaft
19 spring (second spring)
21 pressure roller gear (gear power transmission portion, front stage gear)
22 oil roller gear (gear power transmission portion)
23 one-way clutch
24 drive gear
31 first rotation portion
32 second rotation portion

The invention claimed is:

1. A fixing apparatus that includes two rotating members making press-contact with each other and an oil roller making press-contact with either of the rotating members, and that fixes toner on a recording sheet by passing the recording sheet through a nip area between the rotating members, the fixing apparatus comprising:

a gear power transmission portion that transmits a rotation of a shaft of the rotating member that makes press-contact with the oil roller to a shaft of the oil roller; and a one-way clutch that causes the oil roller to idly rotate in a direction of a driven rotation when the oil roller is driven to rotate by making press-contact with the rotating member, wherein the gear power transmission portion has an oil roller gear provided on the shaft of the oil roller and a front stage gear that is located upstream of the oil roller gear and that meshes with the oil roller gear, wherein the oil roller and the oil roller gear are individually supported so as to be contacted with and separated from the rotating member and the front stage gear, wherein a first spring and a second spring are provided, the first spring biasing the oil roller in a direction close to the rotating member, and the second spring biasing the oil roller gear in a direction close to the front stage gear, and wherein the biasing force by the first spring is less than the biasing force by the second spring.

2. The fixing apparatus according to claim 1, wherein the one-way clutch is idly rotated when a driven rotation speed of the oil roller is higher than a rotation speed transmitted to the oil roller via the gear power transmission portion, and wherein the one-way clutch is locked up when the driven rotation speed is lower than the transmitted rotation speed.

3. The fixing apparatus according to claim 1, wherein a ratio of a peripheral length of the oil roller relative to a peripheral length of the rotating member is smaller than a reduction gear ratio of the gear power transmission portion.

4. The fixing apparatus according to claim 1, wherein a joint portion is provided between the oil roller and a shaft end portion of the oil roller such that the oil roller can be moved in a direction close to and away from the rotating member.

5. An image forming apparatus comprising the fixing apparatus according to claim 1.

6. The fixing apparatus according to claim 2, wherein a ratio of a peripheral length of the oil roller relative to a peripheral length of the rotating member is smaller than a reduction gear ratio of the gear power transmission portion.

7. The fixing apparatus according to claim 2, wherein a joint portion is provided between the oil roller and a shaft end portion of the oil roller such that the oil roller can be moved in a direction close to and away from the rotating member.

8. The fixing apparatus according to claim 3, wherein a joint portion is provided between the oil roller and a shaft end portion of the oil roller such that the oil roller can be moved in a direction close to and away from the rotating member.

9. An image forming apparatus comprising the fixing apparatus according to claim 2.

10. An image forming apparatus comprising the fixing apparatus according to claim 3.

11. An image forming apparatus comprising the fixing apparatus according to claim 4.

* * * * *